United States Patent [19]

Tan

[11] 4,449,485

[45] May 22, 1984

[54] SEPARABLE COMBINATION BOILER

[76] Inventor: P. Lu-John Tan, No. 6, Hsia Yuan Rd., Ta Li Hsiang, Taichung Hsien, Taiwan

[21] Appl. No.: 400,121

[22] Filed: Jul. 20, 1982

[51] Int. Cl.[3] ..... F22B 23/06

[52] U.S. Cl. ..... 122/209 R; 122/214; 122/218; 122/367 C

[58] Field of Search ..... 122/209 R, 213, 214, 122/215, 218, 220, 221, 226, 228, 231, 367 C

[56] References Cited

U.S. PATENT DOCUMENTS

| | | | |
|---|---|---|---|
| 542,281 | 7/1895 | Rogers | 122/218 |
| 547,128 | 10/1895 | Pettibone et al. | 122/214 |
| 595,348 | 12/1897 | Schlemmer | 122/218 |
| 693,870 | 2/1902 | Kuen et al. | 122/209 R |
| 997,963 | 7/1911 | Campbell | 122/214 |
| 1,561,663 | 11/1925 | Prox | 122/209 R |
| 2,401,988 | 6/1946 | Tribuson | 122/214 |
| 2,982,264 | 5/1961 | Scogin | 122/214 |
| 4,282,834 | 8/1981 | Anderson | 122/367 C |

*Primary Examiner*—Henry C. Yuen

*Attorney, Agent, or Firm*—Burns, Doane, Swecker & Mathis

[57] ABSTRACT

A separable combinaton boiler comprising:

a boiler body consisting of at least two horizontally aligned cylindrical boiler units each of which has in each end wall a central opening and a gas port above the central opening for the passage of combustion gases, and a front cover plate and a rear cover plate which are laid over the central opening in the front end wall of the foremost boiler unit and the central opening in the rear end wall of the rearmost boiler unit respectively, said boiler units and front and rear cover plates being separably joined together by fastening means provided thereon;

a heat exchanger contained within said boiler body and divided by said boiler units into an equal number of heat exchanging elements which are interconnected by tubes to allow an uninterrupted flow of heat-transfer medium therethrough;

a burner mounted on said front cover plate with its flame spout extending through a central opening in the front cover plate and the central opening in the front end wall of the foremost boiler unit;

a stack mounted on said boiler body and communicating with an exhaust port formed in one of said cover plates which faces the end of a combustion gas passage defined by said boiler body and heat exchanger.

10 Claims, 6 Drawing Figures

SEPARABLE COMBINATION BOILER

The present invention relates to boilers and particularly to a boiler constructed of a plurality of readily detachable and movable boiler units containing a heat exchanging element.

Known boilers are of one-piece construction. Thus, in the event of breakdown of the boiler in operation, boiler operation must be interrupted for hours or even days, depending on the time consumed in detecting the flaws and repairing; and in many cases the boiler requires to be disassembled for such purposes. Under such circumstances, the plant relying on the boiler for power generation, especially the plant where a serialized, uninterrupted production process is desired, can be adversely affected to a considerable degree. Although in order to avoid the usually lengthy delay in boiler operation resulting from the breakdown an additional identical boiler may be kept in reserve, that would be costly and create a problem of requiring additional space for the additional boiler in the plant. Furthermore, in dependence upon the needs for the power generated in the plant, it sometimes would be more economical to operate a boiler of smaller capacity or higher capacity than the existing boiler so as to match the demands of an associated turbine or engine. In that case, to purchase a new boiler of the desired capacity for replacement of the existing boiler or to retain the existing boiler would both be uneconomical.

The main object of the invention is to provide a separable combination boiler constructed of a plurality of quickly, readily detachable and movable boiler units.

Another object of the invention is to provide a separable combination boiler constructed of a plurality of boiler units each of which is adapted to be replaced by a reserved identical unit in case of leakage or malfunction so that normal operation of the boiler can be restored immediately while the defective unit can be inspected and repaired without haste to serve as a reserved unit.

A further object of the invention is to provide a separable combination boiler constructed of a plurality of identical boiler units which are interchangeable so that in cases where one unit breaks down and no replacement is available, the remaining operable units can be put together to enable the boiler to operate temporarily at lower capacity without untoward interruption until the defective unit is repaired and put back in place.

Another object of the invention is to provide a separable combination boiler constructed of a plurality of boiler units each of which is supported by caster wheels to facilitate its mobility during assembly or detachment and has a window to allow visual inspection of its inner portion.

Still another object of the invention is to provide a separable combination boiler constructed of a plurality of boiler units each of which contains an integral heat exchanging element in multicylinder form to form a combustion chamber and at least one combustion gas passage therein.

An even further object of the invention is to provide a separable combination boiler to obviate undesired delay in boiler operation as a result of breakdown, and to maintain the most economical boiler operation by reducing or increasing the number of boiler units.

These and other objects, features and advantages of the invention will be more apparent from the following description by reference to the accompanying drawings, wherein.

Figure 1:
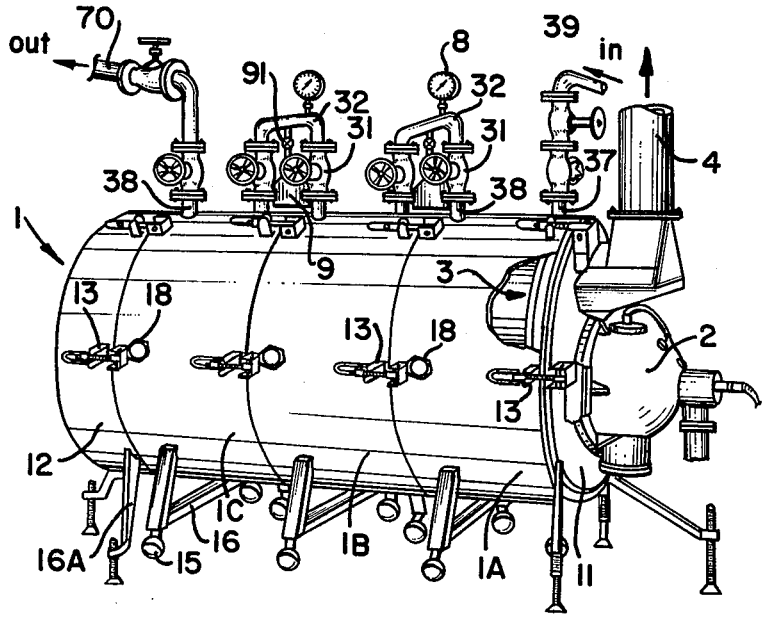
FIG. 1 is a perspective view of one embodiment of the separable combination boiler according to the invention.

With reference to FIG. 1, the separable combination boiler according to the invention comprises mainly a cylindrical boiler body 1, a burner 2 mounted on the front end of the boiler body, a heat exchanger 3 contained in the boiler body, and a stack 4 extending upward from the upper portion of the front end of the boiler body.

The boiler body may be constructed of a plurality of identical cylindrical boiler units (in the embodiment represented in FIG. 1 only three units 1A, 1B and 1C are shown), an annular front cover plate 11 mounted on the front end of the boiler body, and a dome-shaped rear cover plate 12 on the rear end thereof, all being integrally joined by fastening means 13 which will be described in detail later.

Figure 2:
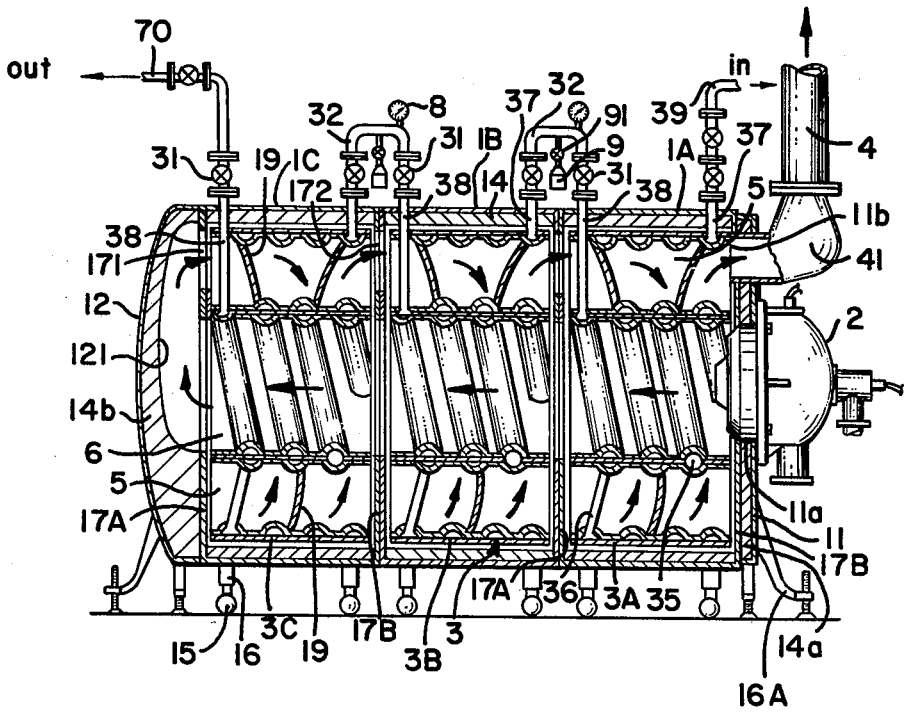
FIG. 2 is a longitudinal sectional side view of the separable combination boiler according to the invention.

As shown in FIG. 2, each of the cylindrical boiler units 1A, 1B and 1C has its inner peripheral wall 14 lined with a refractory material and is provided with a plurality of fastening means 13 on its outer peripheral wall of steel 10. Extending outwardly downwardly from the lower part of each boiler unit are supporting legs 16 provided with caster wheels 15 whereby the units are movably supported. Disposed within and in concentric relationship with each of the cylindrical boiler units 1A, 1B and 1C is a double-cylinder heat exchanging element 3A, 3B and 3C. Each boiler unit is further provided at its opposite ends with corresponding refractory annular plates 17A and 17B respectively. A combustion gas inlet port 171 is formed in the upper middle portion of the annular plate 17A, and a combustion gas outlet port 172 in register with the inlet port 171 is formed in the annular plate 17B. A pair of oppositely arranged apertures 18 provided with a refractory glass pane are formed in the peripheral wall of each unit so as to allow visual access to the inside of same.

Figure 3:
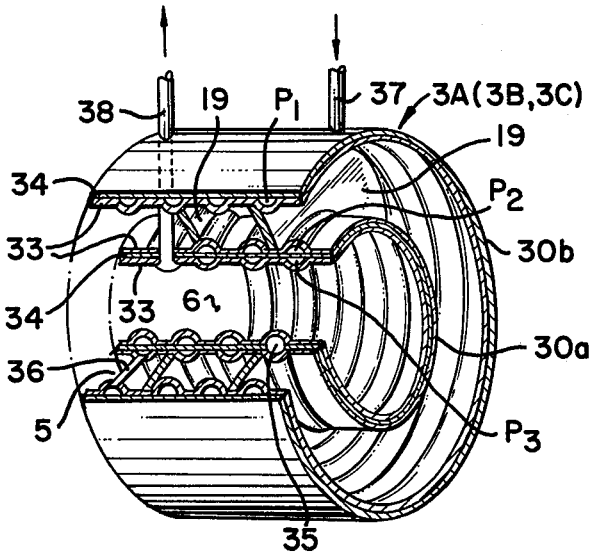
FIG. 3 is a perspective view, partly broken away, of a heat exchanging element employed for the boiler according to the invention.

The double-cylinder heat exchanging elements 3A, 3B and 3C contained respectively within the boiler units 1A, 1B and 1C are interconnected by valves 31 and U-tubes 32 to form the complete heat exchanger 3. As can be seen in FIGS. 2 and 3, each heat exchanging element consists of an inner cylinder **30*a* and an outer cylinder 30*b* between which there is welded a helical combustion gas guide plate 19 surrounding the inner cylinder 30*a* such that a helical combustion gas passage 5 is formed between the inner and outer cylinders of each heat exchanging element. The entrance to and the exit from the helical passage 5 are so arranged as to communicate respectively with the combustion gas inlet port 171 and outlet port 172 in the respective annular plates 17A and 17B of each unit. The space enclosed jointly by the inner cylinders 30***a* of the respective heat exchanging elements constitutes a combustion chamber 6.

The annular front cover plate 11, mounted on the foremost boiler unit 1A by means of the said fastening means 13, has a refractory inner wall 14*a* and a central opening 11*a* in register with the central opening in the annular plate 17B of the unit 1A such that the burner 2 can be partially fitted into both openings in its flame spout facing the combustion chamber 6 in the heat exchanger 3. The front cover plate 11 is further formed with an exhaust port 11*b* in communication with the combustion gas outlet port 172. The stack 4 is connected with the exhaust port 11*b* by a flue tube 41 so that gases from the helical passage 5 may be discharged into the outer atmosphere. The dome-shaped rear cover plate 12, mounted on the rearmost boiler unit 1C also by means of the fastening means 13, has a refractory inner wall 14*b* formed therein with a recess 121 which is so disposed as to direct combustion gases from the end of the combustion chamber 6 into the inlet port 171 in the annular plate 17A of the boiler unit 1C. Both cover plates 11 and 12 have a plurality of vertically adjustable supporting legs 16A.

The heat exchanging elements 3A, 3B and 3C have the same construction. In the embodiment represented in FIG. 3, the inner cylinder 30*a* of each heat exchanging element is constructed of two thermal conductive metal strips 33 which are corrugated to form a plurality of spaced-apart, swerving and arcuate ridges thereon and which are welded onto opposite sides of a flat metal strip 34 of the same material. The thus welded metal strips 33 and 34 are then curved so that both ends of the arcuate ridges meet to form a cylinder. The outer cylinder 30*b* is constructed of one flat metal strip 34 and one corrugated metal strip 33 which is welded to one side (the inner side, when curved into a cylinder) of the flat metal strip, and is of greater diameter than the inner cylinder 30*a*. The smaller inner cylinder 30*a* is concentrically disposed within the outer cylinder 30*b* and held in position by means of the helical guide plate 19 welded between the inner and outer cylinders.

The purpose of the swerving arcuate ridges on each metal strip 33 is to form an advancing helical channel for the passage of heat-transfer medium when the metal strips 33 and 34 are curved into a cylinder. As shown in FIG. 3, the inner cylinder 30*a* is formed with an internal channel P3 and an external channel P2 which are divided by the metal strip 34, and the outer cylinder 30*b* is formed with an internal channel P1. In order that heat-transfer medium may pass from the channel P2 into the channel P3, a predetermined portion of the metal strip 34 dividing the channels P2 and P3 is cut away to create a mutual hole 35 which serves both as an outlet from the channel P2 and as an inlet to the channel P3. For the same purpose but in a different manner, the channels P2 and P1 are connected by means of a tube 36 welded between the outlet from the channel P1 and the inlet to the channel P2. As a result of this interconnecting arrangement of the channels P1, P2 and P3, circulation of heat-transfer medium through the outer cyliner and inner cylinder of each heat exchanging element is made possible.

In order that heat-transfer medium can be passed from the foremost heat exchanging element 1A to the rearmost 1C for ultimate delivery to the area where heat is needed, the heat exchanging elements 3A, 3B and 3C are interconnected in the following manner. As can be seen from FIGS. 2 and 3, each heat exchanging element is provided with an inlet pipe 37 which leads to the channel P1 on the outer cylinder 30*b*, and an outlet pipe 38 which leads from the discharge end of the channel P3, and both the inlet pipe 37 and outlet pipe 38 extend upwardly through the outer cylinder and its enclosing boiler unit. For the connection of the heat exchanging element 3A, the inlet pipe 37 is connected through valve 31 to a heat medium supply pipe 39, and the outlet pipe 38 is connected to the inlet pipe 37 connected to the heat exchanging element 38 by means of a U-tube 32 connected at both ends to the respective valves 31 on these two pipes. In the same manner, the heat exchanging elements 3B and 3C are connected, but the outlet pipe 38 connected to the heat exchanging element 3C is connected to a discharging pipe 70 which leads to the associated turbine or engine (not shown).

A pressure gage 8 for indicating the pressure of the circulating heat-transfer medium is provided on each U-tube 32. Depending from each U-tube is a valve 91 to which a container 9 is detachably attached.

Figure 4:
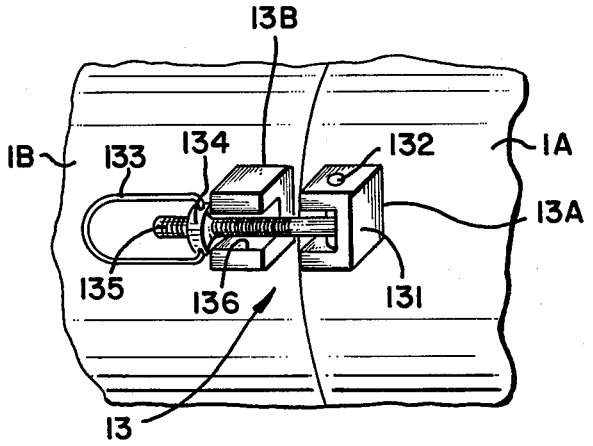
FIG. 4 is a perspective view of a fastening means for joining adjacent boiler units of the boiler.

The fastening means 13, best illustrated in FIG. 4, consists of a bolt pivoting member 13A and a bolt engaging member 13B which are fixed side by side to contiguous boiler parts respectively, e.g., the boiler units 1A and 1B; the boiler unit 1C and rear cover plate 12. The bolt pivot member 13A includes a slotted block 131 with a fixed pin 132 extending vertically therethrough, a bolt 135 is pivotally attached to the pin 132 at one end, and a handle ring 133 secured to a nut 134 screwed onto the other end of the bolt 135. The bolt engaging member 13B may also be a slotted block having a slot 136 within which the bolt 135 can be engaged.

To fasten together contiguous boiler parts, the bolt is engaged within the slot 136 and the handle ring is turned so that the nut 134 is pressed against the bolt engaging member 13B to prevent pivotal movement of the bolt as can be seen from FIG. 4. By turning the handle ring so that the nut moves away from the bolt engaging member, the bolt will be released to enable pivoting of same to a position in which it is disengaged from the slot 136 whereby the boiler parts can be separated from each other.

In operation, fuel, such as heavy oil, is supplied to the burner 2 while a liquid heat-transfer medium is introduced into the heat exchanging element 3A via the supply pipe 39 and the inlet pipe 37. The fuel supplied to the burner will be atomized, ignited, and shot out into the combustion chamber 6. Hot combustion gases generated in the combustion chamber will pass from the boiler unit 1A, 1B, 1C to the rear end of the boiler where they are directed by the recess 121 in the rear cover plate 12 into the helical passage 5 through the inlet port 171 in the annular end plate 17A of the boiler unit 1C. Constrained by the helical guide plate 19 to flow along the helical passage 5, the combustion gases will be channeled back through the respective inlet ports 171 and outlet ports 172 to the exhaust port 11*b* in the front cover plate 11 for delivery to the outside atmosphere via the flue tube 41 and the stack 4.

While the combustion gases are passed through the respective boiler units, the heat-transfer medium is circulated through the respective heat exchanging elements. With reference to FIG. 3, the heat-transfer medium is introduced into the channel P1 of the heat exchanging element 3A through the inlet pipe 37, and then flows through the tube 36 to the channel P2, where it begins travelling around the inner cylinder 30*a* in a direction opposite to that it travels through the channel P1. When it reaches the mutual hole 35, it will flow into the channel P3 and begin travelling, in the same direction as it travels through the channel P1, through the channel P3 to the outlet pipe 38. Through the outlet pipe 38, U-tube 32, and the inlet pipe 37 leading to the channel P1 in the heat exchanging element 3B, the heat-transfer medium finally enters the heat exchanging element 3B, continuing its travel through the passages P1, P2 and P3 in the heat exchanging elements 3B and 3C in the same manner it travels through those in the heat exchanging element 3A until it passes through the discharging pipe 70 into the associated turbine or engine in which the energy absorbed by the medium during its circulation through the heat exchanger is utilized.

Figure 5:
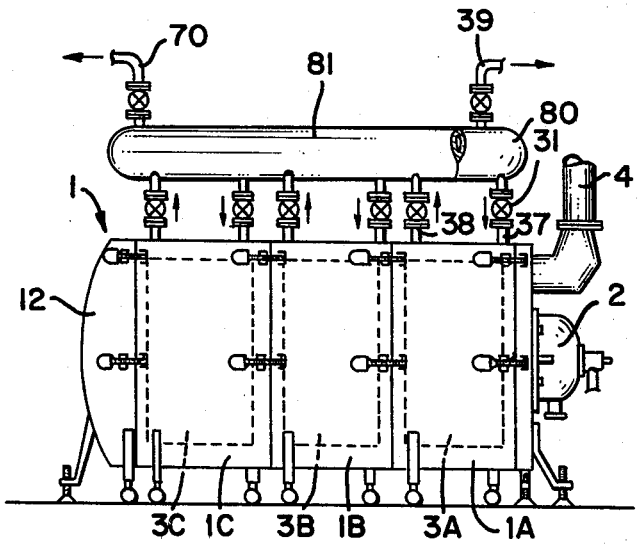
FIG. 5 is a side elevation of a second embodiment of the separable combination boiler according to the invention.
Figure 6:
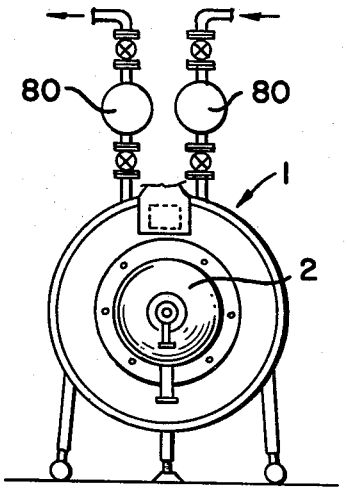
FIG. 6 is a front elevation of the embodiment illustrated in FIG. 5.

In FIGS. 5 and 6 a second embodiment of the boiler according to the invention is represented. However, since the basic construction for this embodiment is identical to that for the first embodiment, except that the heat exchanging elements are not related to one another and additional means for distributing and gathering the heat-transfer medium are provided, further explanation is unnecessary for the identical parts.

In the first embodiment the heat exchanging elements are connected with one another so as to allow a continuous flow of heat-transfer medium from the first heat exchanging element to the last, whereas in this embodiment the heat exchanging elements operate independently of one another in that they are not connected with one another but with a distributing tank 80 which distributes heat-transfer medium into each individual heat exchanging element, and a gathering tank 81 which collects flows of the heat-transfer medium discharged from the respective heat exchanging elements. As shown in the Figures, the distributing tank 80, disposed over the boiler body 1, is connected to the heat medium supply pipe 39 and the respective inlet pipes 37 leading to the respective heat exchanging elements. The gathering tank 81, disposed in parallel with the distributing tank 80 over the boiler body, is connected to the discharging pipe 70 and the respective outlet pipes 38 extending from the respective heat exchanging elements. By this construction, heat-transfer medium can be distributed from the distributing tank into each heat exchanging element through the inlet pipes 37 and discharged, after circulating through the channels P1, P2 and P3 in each heat exchanging element, through the outlet pipes 38 into the gathering tank where they are collected for ultimate delivery to the associated turbine or engine through the discharging pipe 70.

From the foregoing description it will be appreciated that the boiler according to the invention has the following advantages and functions.

1. The ready detachability and movability of the boiler units contribute to easy assembly and installation of the boiler.

2. Safety in boiler operation is ensured. Since the windows in the boiler body enable visual inspection of the interior of the boiler body, the operator can detect adverse conditions in the boiler such as leakage of the heat-transfer medium and take necessary measures immediately.

3. In the event of malfunction of any boiler unit of the boiler, the operation of the boiler can be restored in a short time by supplanting the defective boiler unit with a reserved one so that losses resulting from the malfunction can be reduced to a minimum. To replace a defective unit, the following sequence should be observed:

For the boiler represented in the first embodiment: Stop the boiler by closing the valves on the supply pipe and discharging pipe and the valves on the defective unit and its adjoining unit(s). Open the valve 91 disposed under the U-tube 32 so that the heat medium contained in the U-tube drops into the container 9. Detach the U-tube and release the bolt 135 from the bolt engaging member 13B to enable the defective unit to be separated from the adjoining unit(s). Remove the defective unit and push a reserved unit to its position to take its place. Join the reserved unit to its adjoining unit(s) by means of the fastening means 13 and put the U-tube back in its former position. Open the closed valves to resupply heat-transfer medium to the boiler and operate the burner.

For the boiler represented in the second embodiment: Stop the burner and cut off the supply of heat-transfer medium to the boiler by closing the related valves. Detach the inlet pipe and outlet pipe of the defective unit from the valves 31 so that the defective unit is disconnected with the distributing tank and the gathering tank. Detach the defective unit from its adjoining unit(s) by releasing the fastening means so that the reserved unit may take its place. Attach the inlet and outlet pipes of the reserved unit to the valves 31 and fasten the reserved unit to the adjoining unit(s) by means of the fastening means. Open the closed valves to resupply heat-transfer medium to the boiler and operate the burner.

Usually the operation of the boiler can be brought back to normal in ten-odd minutes, so that losses resulting from the delay in operation of the boiler, often considerable for the conventional boilers that would require hours or days to be repair for reuse, are minimized.

4. For the boiler represented in the first embodiment, there is an additional advantage that in the event of malfunction of any one of the boiler units, even without a reserved unit to take the place of the defective unit, the remaining operable units can be joined together to operate temporarily without the need to delay the operation of the boiler until the defective unit is repaired for reuse.

While only preferred embodiments of the invention have been shown and described, it will be apparent to those skilled in the art that the invention is not limited thereby and modifications can be made without departing from the principles and the scope of the appended claims. For example, while corrugated metal strips welded to a flat metal strip are used to form a heat exchanging element, steel tubes wound in a coil and welded to the inner and/or outer surface of a flat metal strip curved into a cylinder may be used for this purpose. Further, the heat exchanging element may take the form of a single cylinder or multicylinder other than that of a double-cylinder.

I claim:

1. A separable combination boiler comprising a boiler body including:

at least two horizontally aligned cylindrical boiler units each of which has in each end wall a central opening and a gas port above the central opening for the passage of combustion gases, and a front cover plate and a rear cover plate which are laid over the central opening in the front end wall of the foremost boiler unit and the central opening in the rear end wall of the rearmost boiler unit respectively, said boiler units and front and rear cover plates being separably joined together by fastening means provided thereon;

a heat exchanger contained within said boiler body and divided by said boiler units into an equal number of heat exchanging elements which are interconnected by tubes to allow an uninterrupted flow of heat-transfer medium therethrough;

a burner mounted on said front cover plate with its flame spout extending through a central opening in the front cover plate and the central opening in the front end wall of the foremost boiler unit;

a stack mounted on said boiler body and communicating with an exhaust port formed in one of said cover plates which faces the end of a combustion gas passage defined by said boiler body and heat exchanger;

wherein each heat exchanging element is constructed of at least one inner cylinder serving as a combustion chamber and one outer cylinder which are concentrically arranged within each boiler unit and spaced apart from each other by a helical plate surrounding the inner cylinder so as to form therebetween a helical passage for combustion gases, said helical passage extending from the gas port in one end wall of the boiler unit to the gas port in the other end wall thereof.

2. A separable combination boiler according to claim 1, wherein each boiler unit is movably supported by a plurality of supporting legs fitted with a caster wheel.

3. A separable combination boiler according to claim 1, wherein each heat exchanging element is formed with an inlet pipe and an outlet pipe which extend upwardly through the upper peripheral wall of its enclosing boiler unit for directing heat-transfer medium into and out from same.

4. A separable combination boiler according to claim 1, wherein said front cover plate and rear cover plate are each provided with a plurality of vertically adjustable supporting legs extending downwardly from the lower portion thereof.

5. A separable combination boiler according to claim 1, wherein said rear cover plate is formed in its inner wall with a recess for directing hot combustion gases from the combustion chamber in the rearmost boiler unit to the gas port leading to the spiral passage in the rearmost boiler unit.

6. A separable combination boiler according to claim 1, wherein said front cover plate is formed with an exhaust port in communication with the gas port in the front end wall of the foremost cover plate.

7. A separable combination boiler according to claim 1, wherein said heat exchanging element contained within said boiler units respectively are interconnected by means of a U-tube connected at one end to the inlet pipe of one heat exchanging element and at the other end to the outlet pipe of the adjacent heat exchanging element.

8. A separable combination boiler according to claim 7, wherein said U-tube is provided with a container detachably attached to a valve suspended from the U-tube.

9. A separable combination boiler according to claim 1, wherein said inner cylinder of each heat exchanging element is covered both on its inner peripheral surface and on its outer peripheral surface with a corrugated metal strip with swerving arcuate ridges to form an internal helical channel and an external helical channel which communicate with each other by virtue of a mutual hole formed in a predetermined portion of said inner cylinder, and wherein said outer cylinder of each heat exchanging element is covered on its inner peripheral surface with a corrugated metal strip with swerving arcuate ridges to form an internal helical channel which is connected at one end by a tube with the external channel on said inner cylinder.

10. A separable combination boiler according to claim 9, wherein each heat exchanging element is formed with an inlet pipe and an outlet pipe which extend upwardly through the upper peripheral wall of its enclosing boiler unit for directing heat-transfer medium into and out from same, said inlet pipe is connected at the lower end to the internal channel and on said outer cylinder and said outlet pipe is connected at the lower end on to the internal channel on said outer cylinder.

* * * * *